US006503176B2

(12) United States Patent
Kuntz

(10) Patent No.: US 6,503,176 B2
(45) Date of Patent: Jan. 7, 2003

(54) WALKER DEVICE WITH POWER ASSISTED LIFT

(76) Inventor: James P. Kuntz, 13023 Tall Tree Rd., Spokane, WA (US) 99216

( * ) Notice: Subject to any disclaimer, the term of this patent is extended or adjusted under 35 U.S.C. 154(b) by 0 days.

(21) Appl. No.: 09/747,223

(22) Filed: Dec. 26, 2000

(65) Prior Publication Data

US 2002/0082148 A1 Jun. 27, 2002

(51) Int. Cl.[7] ..... A63D 22/00; A47D 13/04; A61H 3/00

(52) U.S. Cl. ..... 482/66; 482/51; 482/68

(58) Field of Search ..... 482/51, 66–69; 135/65–67; 297/5–7

(56) References Cited

U.S. PATENT DOCUMENTS 4,266,765 A * 5/1981 Sandoval et al. ..... 272/70.3
4,907,794 A * 3/1990 Rose ..... 272/70.3
4,948,156 A * 8/1990 Fortner
4,948,456 A * 8/1990 Fortner ..... 280/304
6,139,475 A * 10/2000 Bessler et al. ..... 482/69

* cited by examiner

*Primary Examiner*—Michael A. Brown
*Assistant Examiner*—Lori Baker Amerson
(74) *Attorney, Agent, or Firm*—David S. Thompson

(57) ABSTRACT

A walker device (20) includes a frame assembly (30), which supports the user during operation and carries the other assemblies discussed below. Left and right front wheel assemblies (50) include a pivoting fork supporting a wheel, thereby allowing directional control over the walker during use. Left and right rear wheel assemblies (70) are fixed-direction. A brake assembly (90) allows the user to apply a frictional brake element to the both rear wheels, and prevents unwanted movement by the walker. A support sling assembly (190) carries some or all of the user's weight. Left and right lift cylinder assemblies (150), (170) lift and lower the support sling assembly to the desired elevation during use. A compressed air assembly (110) provides power to the lift cylinder assemblies. A valve assembly (130) provides independent control over both lift cylinder assemblies, to provide extra help to one side, if needed.

6 Claims, 4 Drawing Sheets

110
111
115
116
117
118
119
120
131
132
133
134
135
136
137
156

WALKER DEVICE WITH POWER ASSISTED LIFT

CROSS-REFERENCES

There are no applications related to this application filed in this or any foreign country.

BACKGROUND

Walkers are devices that are commonly used by the elderly and others needing assistance in walking. A typical walker design provides a frame having two forward wheels and two rear feet. The device is used with each hand grasping the frame and advancing it incrementally, by either dragging or lifting the walker's rear feet with each step taken by the user. The frame provides support for the user between steps.

A first problem exists in that the frame is made more difficult to move by the rear feet, which must be lifted or dragged. However, the feet provide the friction needed with the sidewalk or floor to prevent the walker from rolling out from under the user.

A second problem is that while the walker provides substantial support for the user's body weight, that support must be gained by use of the upper body muscles required to manually grasp and hold the frame. As a result, use of such walkers is generally fatiguing to all major muscle groups. When the user becomes exhausted, no desirable course of action is available. The user simply must advance the walker until a seating area is found.

Another problem the users of such walkers face is that of initially elevating one's body to the standing position. The strength required for such movement is often substantially greater than actually walking, particularly where the user may lean on the walker for assistance. Therefore, there are those who will be unable to use a walker because they lack the strength required to elevate their body to the standing and walking position.

For the foregoing reasons, there is a need for a walker that can assist with the elevation of the user's body, that can provide support to the user without the requirement of upper body strength, and that does not require the use of a foot structure on the walker that drags to prevent the possibility of the walker rolling out from under the user.

SUMMARY

The present invention is directed to an apparatus that satisfies the above needs. A novel walker device with power assisted lift is disclosed that can assist with the elevation of the user's body; that can provide support to the user without the requirement of upper body strength; and that does not require the use of a foot structure on the walker that drags to prevent the possibility of the walker rolling out from under the user.

The walker device with power-assisted lift of the present invention provides some or all of the following structures.

(A) A frame assembly 30 is typically made of steel or aluminum pipe, and provides left and right upper frame elements that may be conveniently gripped by the user during operation.

(B) Front and rear wheel assemblies 50, 70 are carried by four lower corners of the frame assembly. The front wheel assemblies pivot independently, while the rear wheel assemblies hold their respective wheels in a fixed orientation.

(C) A brake assembly 90 having two pedals applies a frictional brake element to the outer surface of the rear wheels when applied.

(D) A compressed air assembly 110 includes an air tank, gauges and supporting hardware, as well as air hoses to the valve assembly.

(E) A preferred valve assembly 130 includes four valves. Left and right pressure valves allow compressed air from the master pressure valve to enter the left and right cylinders of the left and right lift assemblies, respectively. Left and right exhaust valves allow air to leave their respective cylinders, and to reach a master exhaust valve, from which the air may be permanently exhausted. Additionally, a master pressure valve that controls the release of compressed air from the tank (F) Left and right lift cylinder assemblies 150, 170 receive air from the left and right pressure valves, respectively, and lift the support sling assembly. Air released from the left and right exhaust valves lowers the support sling assembly.

(G) A support sling assembly 190, carried between the left and right lift cylinder assemblies and using power from the lift assembly, lifts and lowers the user, as desired.

It is therefore a primary advantage of the present invention to provide a novel walker device with power assisted lift that assists with the elevation of the user's body, and which allows one side of the user's body to receive more assistance than the other side, where a stroke or other condition indicates uneven support to be advantageous.

Another advantage of the present invention is to provide a novel walker device with power assisted lift that provides support to the user without the requirement of upper body strength, and in particular allows allowing the user to relax and be carried by the support sling.

Another advantage of the present invention is to provide a novel walker device with power assisted lift that allows the air pressure in the left and right lift cylinder assemblies to be equalized by opening the left and right exhaust valves, but not reduced overall when the master exhaust valve is closed.

A still further advantage of the present invention is to provide a novel walker device with power-assisted lift that includes a brake assembly that allows control by the user over rotation of the rear wheels.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

DESCRIPTION

Figure 1:
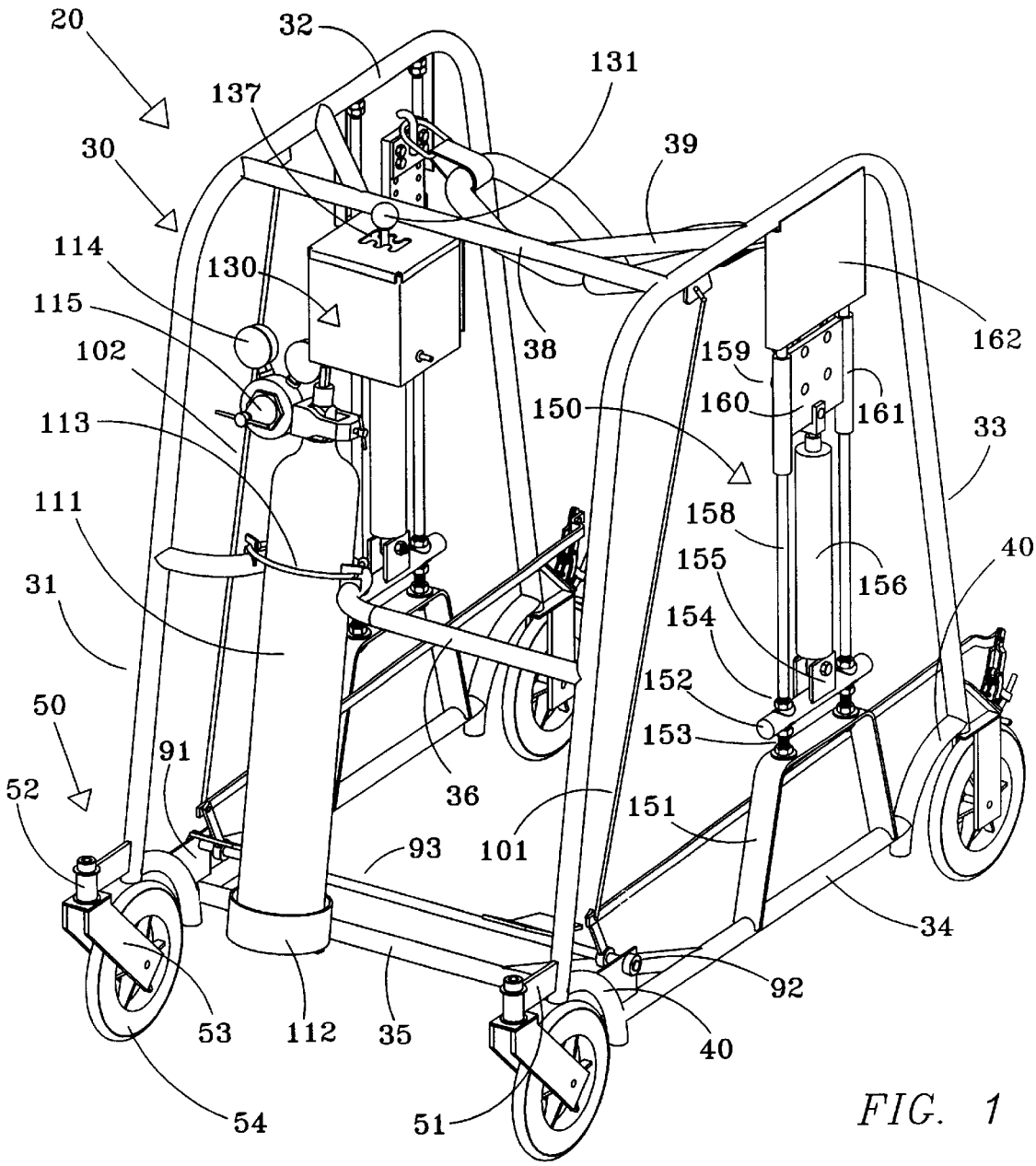
FIG. 1 is an isometric perspective view of a preferred version of the walker device with power-assisted lift, with the upper front left portion of the device in the foreground.

Referring in generally to FIGS. 1 through 4, a walker device 20 constructed in accordance with the principles of the invention is seen. A preferred walker device includes a frame assembly 30, which supports the user during operation and carries the other assemblies discussed below. Left and right front wheel assemblies 50 include a pivoting fork supporting a wheel, thereby allowing directional control over the walker during use. Left and right rear wheel assemblies 70 are fixed-direction. A brake assembly 90 allows the user to apply a frictional brake element to the both rear wheels, and prevents unwanted movement by the walker. A support sling assembly 190 carries some or all of the user's weight. Left and right lift cylinder assemblies 150, 170 lift and lower the support sling assembly to the desired elevation during use. A compressed air assembly 110 provides power to the lift cylinder assemblies. A valve assembly 130 provides independent control over both lift cylinder assemblies, in a manner that allows extra lift to be provided to one side, if needed.

Figure 2:
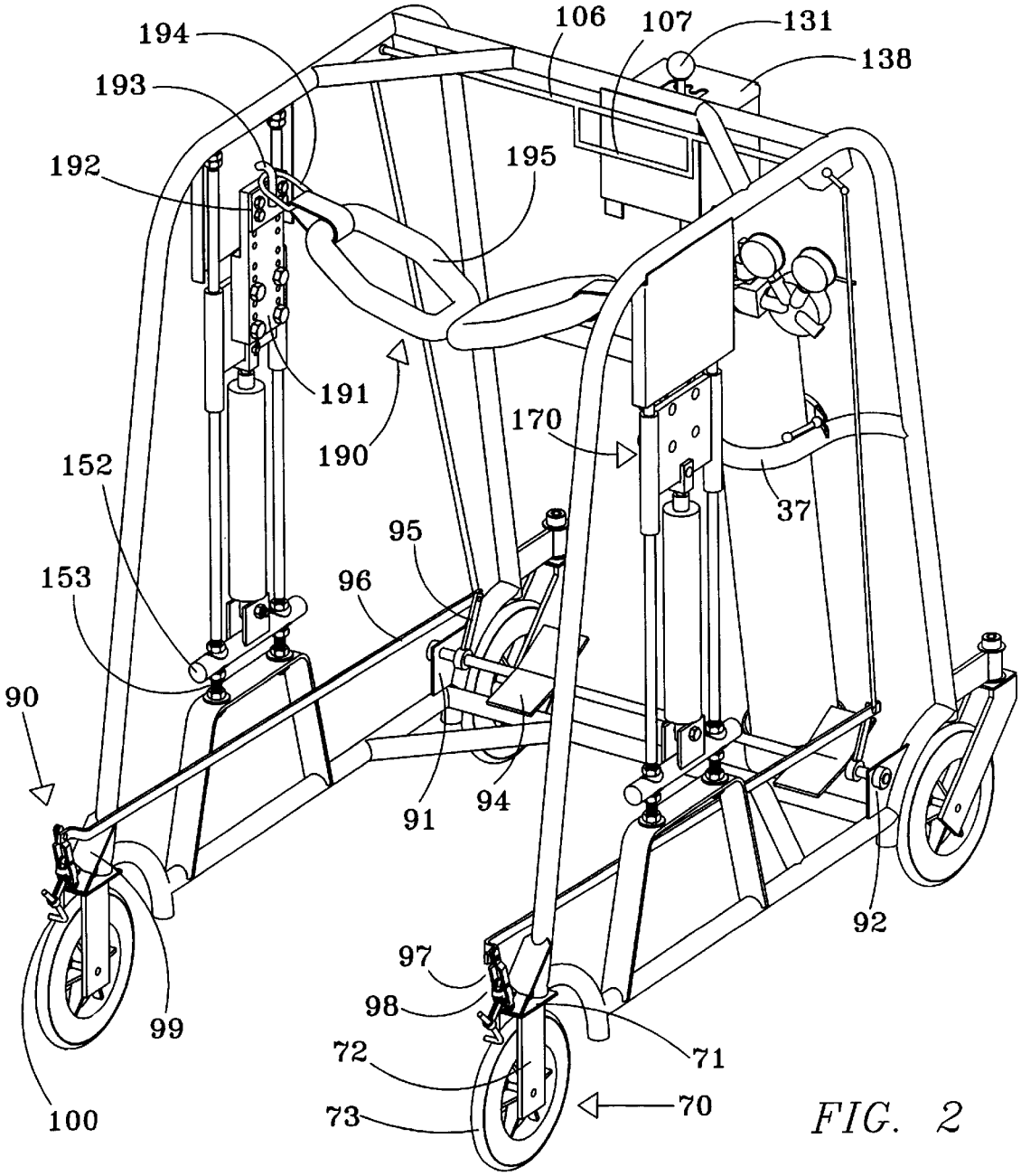
FIG. 2 is an isometric perspective view of the walker device of FIG. 1, having the upper right rear portion of the device in the foreground.
Figure 3:
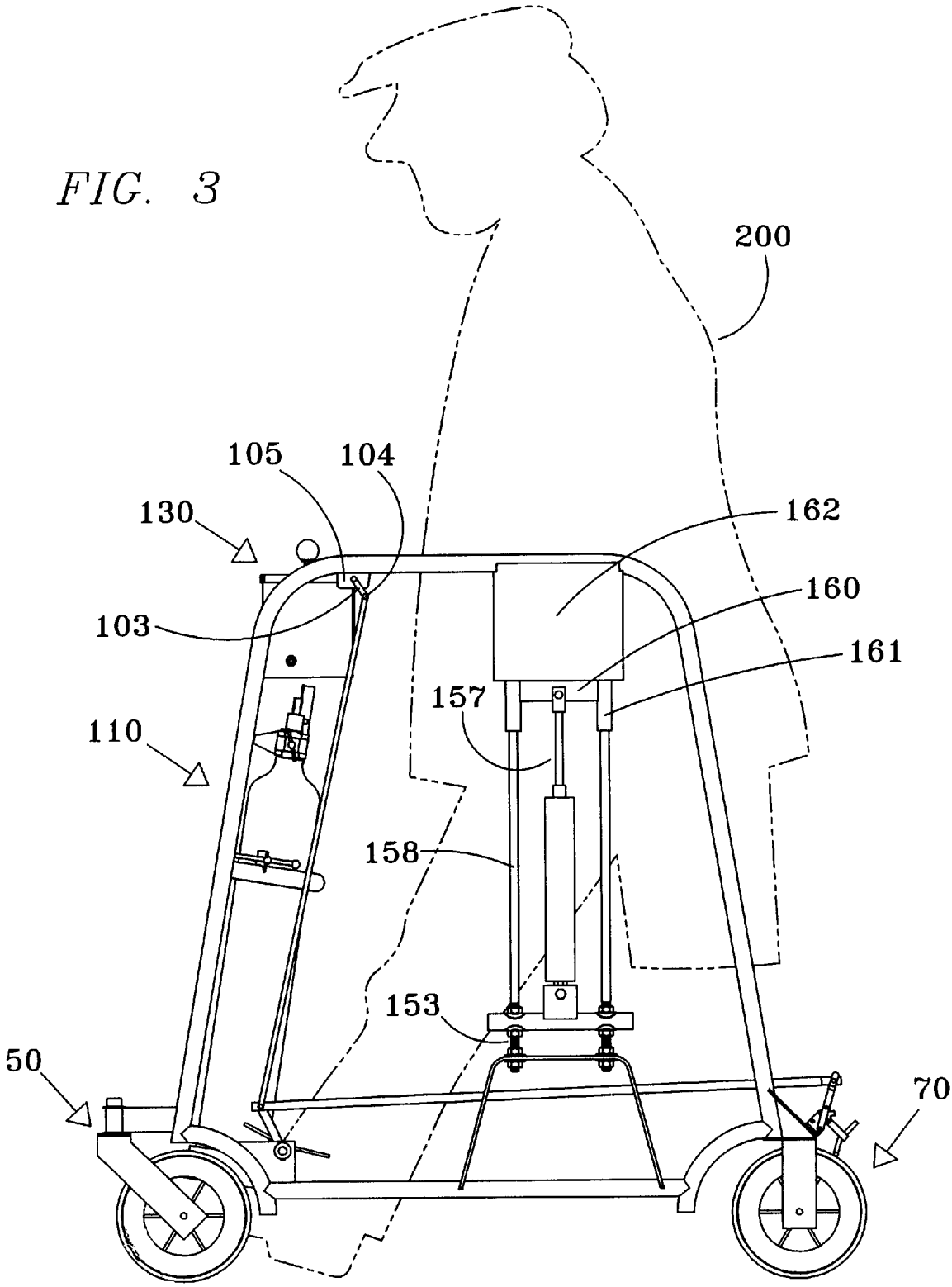
FIG. 3 is an orthographic view of the left side of the walker device of FIG. 1, showing the lift cylinder assemblies and the support sling assembly in an elevated position.

As seen in FIGS. 1 through 3, a frame assembly 30 is typically made of steel or aluminum pipe, but could be made of any material suitable for supporting the weight of any user 200 who could reasonably be expected to use the device.

Referring particularly to FIG. 3, on the left and right sides of the frame, front and rear frame elements 31, 33 carry an upper frame element 32. The upper frame element is adapted for manual grasping by the user in a manner similar to conventional walkers. On the left and right sides of the frame assembly, a side bar 34, having front and rear ends carrying front and rear rounded corners 40, connects lower portions of the front and rear frame elements, resulting in a rigid frame.

The left and right sides of the frame assembly are connected by a lower cross member 35, a middle cross member 36 and an upper cross member 38. The middle cross member may be modified by a C-curve 37, which supports the air tank 111. Alternatively, a bracket may replace the C-curve 37, and the middle cross member 36 may be straight.

Referring particularly to FIGS. 1 and 2, left and right braces 39 may be used to connect the upper cross member 38 and left and right upper frame elements 32.

As seen particularly in FIGS. 1 and 3, left and right front wheel assemblies 50 are carried by the frame. Each front wheel assembly includes a support bracket 51, which is typically attached to a lower portion of the front frame element 31 of the frame 30. The support bracket in turn carries a pivot 52 that allows the front wheel fork 53 to rotate about an axis perpendicular to the floor. The wheel fork carries a wheel 54, which is typically 4" to 6" in diameter, but could be any suitable size.

Referring particularly to FIGS. 2 and 3, left and right rear wheel assemblies 70 are carried by the frame. Each rear wheel assembly includes a support bracket 71 that is typically attached to the lower end of the rear frame element 33. A fork 72 is attached to the support bracket in a fixed manner that does not allow rotation. The fork carries a wheel 73 that is typically approximately the same size as the front wheel.

A brake assembly 90 allows the user to prevent undesired movement of the walker device 20. As seen in FIGS. 1, 2 and 3, the brake assembly may be activated by foot pedals 94 or manually by a handle 107.

Referring particularly to FIGS. 2 and 3, the structure of the braking assembly and foot pedals may be understood. A forward portion of the brake assembly is supported by left and right brackets 91 carried by lower portion of the left and right front frame elements 31. The brackets support a journal and bearing 92, which in turn support left and right ends of a pedal support rod 93. The pedal support rod is oriented horizontally, parallel and adjacent to the lower cross member 35. The pedal support rod supports left and right pedals 94. A rocking motion of the pedals results in rotation of the pedal support rod.

The pedal support rod also carries the first ends of the left and right lever arms 95. Rotation of the pedal support rod results in front-to-back movement of the second end of left and right lever arms 95. A forward end of left and right drive rods 96 are attached at a pivot to the second end of the lever arms. In operation, the drive rods move, in response to movement of either pedal, in a substantially linear manner, between a forward position wherein the brakes are released, and a rearward position wherein the brakes are frictionally engaged.

The rear end of the drive rods 96 are connected to a first pivot 97 that is attached to a second pivot 98. Both pivots are attached to a bracket 99 that is supported by the lower end of the rear frame element 33. The second pivot carries the brake element 100 that frictionally applied to the surface of the rear wheel 73. When the pedal 94 is pushed, the pivots cooperate in a manner that provides leverage between the brake pedal and the brake element, in that movement through a greater range by the pedal results in leveraged movement through a smaller range by the brake element 100.

Referring particularly to FIG. 2, the structure of the manually operated portions of the brake assembly 90 may be understood. Left and right vertical brake rods 101, 102 connect the left and right lever arms 95 to pivots 104 carried by the moving ends of left and right upper levers 103. The pivoting ends of the upper levers 103 are attached to the ends of a horizontal brake rod 106 the journal of which is supported by bearings in a pivot lever mounting plate 105. A handle 107 is carried by a middle portion of the horizontal brake rod 106.

In operation, movement of the handle 107 rotates the horizontal brake rod 106. Rotation of the horizontal brake rod moves the left and right upper levers 103. The moving ends of the upper levers push downwardly on the left and right brake rods 101, 102, which in turn activate the brake elements 100 against each rear wheel.

A compressed air assembly 110 includes an air tank, gauges and supporting hardware, as well as air hoses to the valve assembly. The compressed air assembly provides the power needed to drive the left and right lift cylinder assemblies 150, 170, and is regulated by the valve assembly 130.

As seen in particularly in FIG. 1, a lower portion of an air tank 111 is carried by a supporting base 112 mounted on the lower cross member 35 of the frame 30. A fastening belt 113 within the C-curve 37 defined in the middle cross member 35 of the frame secures an upper portion of the air tank. In a typical application, the air tank 111 includes gauges 114 and a valve 115.

Figure 4:
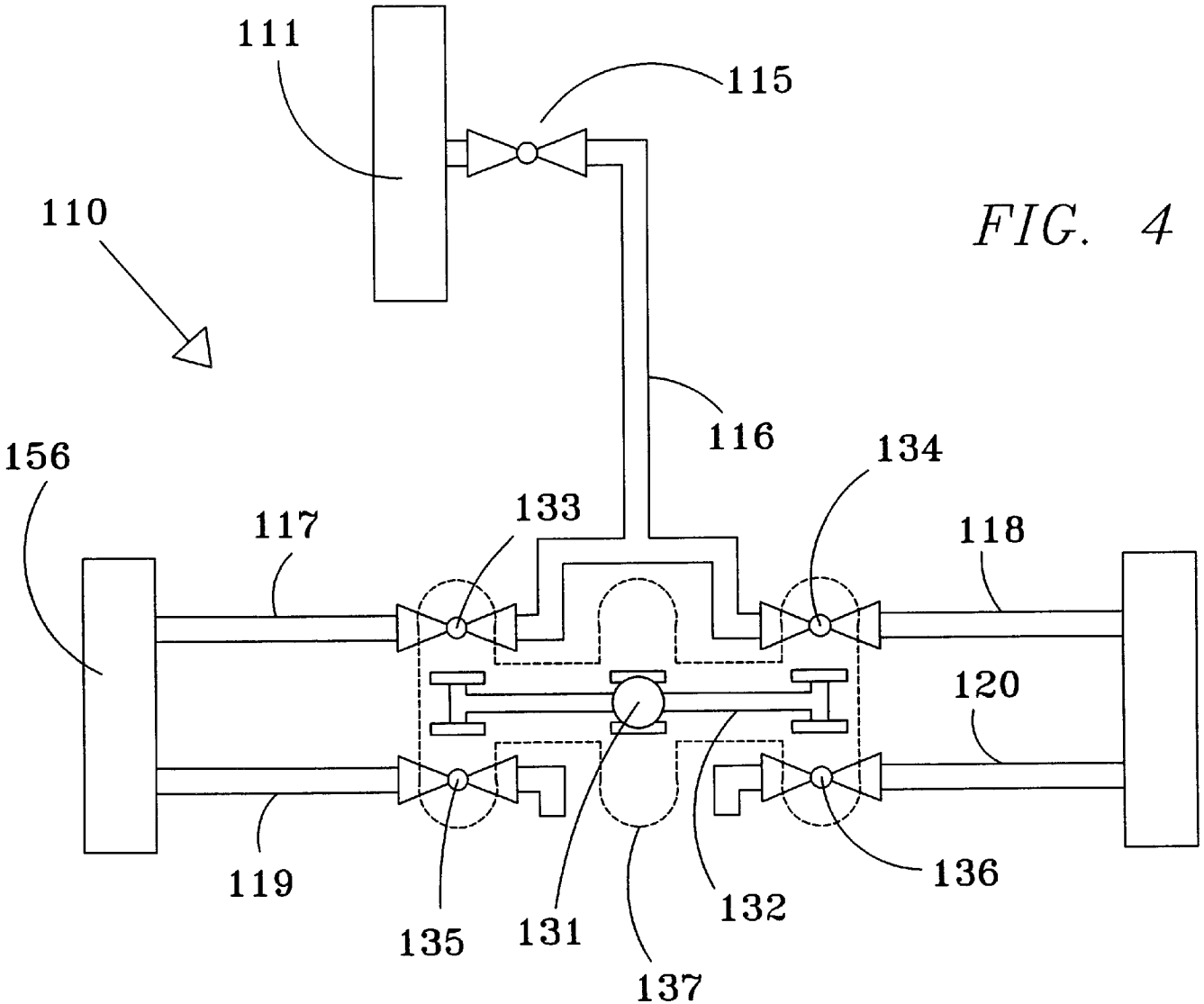
FIG. 4 is a schematic view of the compressed air assembly, the valve assembly and the left and right left lift cylinder assemblies.

As seen in FIG. 4, a preferred valve assembly 130 includes four valves. Left and right pressure valves 133, 134 allow compressed air from the air tank 111 to enter the left and right cylinders of the left and right lift cylinder assemblies 150, 170, respectively. Left and right exhaust valves 135, 136 allow air to leave their respective cylinders, from which the air is permanently exhausted.

The compressed air assembly includes air hose made of tubing suited for use under pressure. Air hose 116 connects the master pressure valve carried by the air tank 111 with the left and right pressure valves 133, 134. Air hoses 117, 118 connect the left and right pressure valves to the left and right cylinders, respectively. Air hoses 119, 120 connect the left and right cylinders to the left and right exhaust valves 135, 136, respectively.

Referring to FIGS. 1 and 4, it can be seen that a joystick 131 or similar control handle moves within an opening defining a six-lobed pattern 137 on an upper surface of an enclosure 138 within which the pressure valves 134, 135 and exhaust valves 135, 136 are contained. The joystick carries a contact bar 132, which may be used to activate the left and right pressure valves 133, 134 and the left and right exhaust valves 135, 136. The six-lobed pattern allows the joystick to be conveniently located in any of six locations. Referring to FIG. 4, it can be seen that where the joystick is in the upper left location, the contact bar 132 would activate the left pressure valve 133, thereby adding air to the left cylinder. Where the joystick is in the upper middle location, the contact bar would activate both valves 133, 134, adding air to both cylinders. Where the joystick is in the upper right position, air would be added to the right cylinder. Similarly, where the joystick is in the lower left position, air would be exhausted from the left cylinder; where the joystick is in the lower middle location, air is exhausted from both cylinders; and where the joystick is in the lower right position, air is exhausted from the right cylinder.

Left and right lift cylinder assemblies 150, 170 receive air from the left and right pressure valves 133, 134, respectively, and lift the left and right sides of the support sling assembly 190, respectively. Air released from the left and right exhaust valves 135, 136 retracts the cylinder rods 157 into the cylinders 156, and lowers the support sling assembly. Referring to FIGS. 1 and 2, the lift cylinders are in their lowered position. As seen in FIG. 3, the lift cylinders are in a somewhat raised position.

In a preferred embodiment, the left and right lift cylinder assemblies are identical or mirror images, each having the following structures. A support bracket 151 is carried by the lower side bar 34 of the frame. Left and right slide bars 158 extend vertically from the support bracket. A lower portion 153 of each slide bar is threaded, allowing attachment to the support bracket with nuts or similar fastening hardware.

A horizontally oriented adjustable base 152 is attached to the threaded portion 153 of each slide bar 158 and secured from above and below by adjustment nuts 154 or similar fasteners. By moving the nuts up or down the threaded portion 153, the base 152 may be moved up or down, as needed to regulate the lowest point to which the support sling assembly 190 may be lowered.

Each base supports a pair of fastening ears 155 attached to a lower end of a cylinder 156. A lower end of a cylinder rod 157 is attached to a piston carried within the cylinder. The cylinder rod extends when compressed air is applied to the cylinder. The upper end of the cylinder rod is attached to a slide 159 that moves up and down the slide bars 158 in response to compressed air moving into and out of the cylinder.

Continuing to refer to FIGS. 1 through 3, the slide 159 includes a base 160 having vertically oriented forward and rear bearings 161 sized to slide on the forward and rear vertical slide bars 158. When the slide is fully elevated, due to compressed air fully extending the cylinder rod 157 from the cylinder 156, the slide is fully carried within the enclosure 162.

A support sling assembly 190, adjustably carried between the left and right lift cylinder assemblies 150, 170, supports the user during operation.

The left and right sides of the support sling assembly are attached to the base 160 of the left and right lift cylinder assemblies in a manner that allows vertical adjustment. In particular, the left and right bases 160 of each slide carry left and right adjustable bases 191. As seen in FIG. 1, each adjustable base 191 includes a plurality of vertically arrayed adjustment hole pairs. Left and right fastening brackets 192 may be attached to any desired pair of adjustment holes, at any selected elevation.

The left and right fastening brackets carry a sling support fastener 193, which is easily attached to left and right sling fasteners 194, respectively. The left and right sling support fasteners are carried by left and right leg supports 195, respectively. The leg supports are sized to encircle one of the user's legs, and together may support all or part of the user's weight.

The previously described versions of the present invention have many advantages, including a primary advantage of providing a novel walker device with power assisted lift that assists with the elevation of the user's body, and which allows one side of the user's body to receive more assistance than the other side, where a stroke or other condition indicates uneven support to be advantageous.

Another advantage of the present invention is to provide a novel walker device with power assisted lift that provides support to the user without the requirement of upper body strength, and in particular allows allowing the user to relax and be carried by the support sling.

Another advantage of the present invention is to provide a novel walker device with power assisted lift that allows the air pressure in the left and right lift cylinder assemblies to be equalized by opening the left and right exhaust valves, but not reduced overall when the master exhaust valve is closed.

A still further advantage of the present invention is to provide a novel walker device with power-assisted lift that includes a brake assembly that allows control by the user over rotation of the rear wheels.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while a preferred valve structure was disclosed, it is clear that some variation of the valves could be made, and still result in some of the advantages of the preferred version. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A walker device, comprising:

(A) a frame assembly;

(B) left and right front wheel assemblies carried by the frame;

(C) left and right rear wheel assemblies, carried by the frame, the left and right rear wheel assemblies each comprising:

(a) a support bracket, attached to the frame assembly;
(b) a fork, carried by the support bracket; and
(c) a wheel, carried by the fork;

(D) a brake assembly, carried by the frame, comprising:
(a) left and right brackets, carried by the frame;
(b) a pedal support rod, supported by bearings carried by the left and right brackets;
(c) at least one pedal, carried by the pedal support rod;
(d) left and right lever arms, extending from the pedal support rod;
(e) left and right drive rods extending from the left and right lever arms, respectively; and
(f) left and right brake elements, driven by the left and right drive rods, respectively, between a first position wherein the left and right brake elements are not in contact with the left and right rear wheels, and a second position wherein the left and right brake elements are in contact with the left and right rear wheels;

(E) left and right lift cylinder assemblies carried by the frame;

(F) a compressed air assembly, comprising an air tank carried by the frame assembly;

(G) a valve assembly in communication with the air tank and the left and right lift cylinder assemblies; and (H) a support sling assembly, carried between the left and right lift cylinder assemblies.

2. The walker device of claim 1, wherein the left and right front wheel assemblies each comprise:

(a) a support bracket, attached to the frame assembly;

(b) a pivot, carried by the support bracket;

(c) a fork, carried by the pivot; and (d) a wheel, carried by the fork.

3. The walker device of claim 1, wherein the valve assembly comprises:

(a) left and right pressure valves, connected to the left and right lift cylinder assemblies and to the air tank, respectively;

(b) left and right exhaust valves, connected to the left and right lift cylinder assemblies; and (c) a joystick, movable between a first position in contact with the left pressure valve, a second position in contact with the left and right pressure valves, a third position in contact with the right pressure valve, a fourth position in contact with the right exhaust valve, a fifth position in contact with the left and right exhaust valves and a sixth position in contact with the right exhaust valve.

4. A walker device, comprising:

(A) a frame assembly;

(B) left and right front wheel assemblies carried by the frame;

(C) left and right rear wheel assemblies carried by the frame;

(D) a break assembly, carried by the frame, comprising:
(a) left and right brackets, carried by the frame;
(b) a pedal support rod, supported by bearings carried by the left and right brackets;
(c) at least one pedal, carried by the pedal support rod;
(d) left and right lever arms, extending from the pedal support rod;
(e) left and right drive rods extending from the left and right lever arms, respectively; and
(f) left and right bracket elements, driven by the left and right drive rods, respectively, between a first position wherein the left and right brake elements are not in contact with the left and right rear wheels, and a second position wherein the left and right brake elements are in contact with the left and right rear wheels;

(E) left and right lift cylinder assemblies carried by the frame;

(F) a compressed air assembly, comprising an air tank carried by the frame assembly;

(G) a valve assembly in communication with the air tank and the left and right lift cylinder assemblies; and (H) a support sling assembly, carried between the left and right lift cylinder assemblies.

5. A walker device, comprising:

(A) a frame assembly;

(B) left and right front wheel assemblies carried by the frame;

(C) left and right rear wheel assemblies carried by the frame;

(D) a break assembly, carried by the frame;

(E) left and right lift cylinder assemblies carried by the frame;

(F) a compressed air assembly, comprising an air tank carried by the frame assembly;

(G) a valve assembly, in communication with the air tank and the left and right lift cylinder assemblies, the value assembly comprising:
(a) left and right pressure valves, connected to the left and right lift cylinder assemblies and to the air tank, respectively;
(b) left and right exhaust valves, connected to the left and right lift cylinder assemblies; and
(c) a joystick, movable between a first position in contact with the left pressure valve, a second position in contact with the left and right pressure valves, a third position in contact with the right pressure valve, a fourth position in contact with the right exhaust valve, a fifth position in contact with the left and right exhaust valves and a sixth position in contact with the right exhaust valve; and (H) a support sling assembly, carried between the left and right lift cylinder assemblies.

6. A walker device, comprising:

(A) a frame assembly having left and right upper frame elements, connected by an upper frame element and sized for manual gripping during operation;

(B) left and right front wheel assemblies carried by the frame, each wheel assembly comprising:
(a) a support bracket, attached to the frame assembly;
(b) a pivot, carried by the support bracket;
(c) a fork, carried by the pivot; and
(d) a wheel, carried by the fork;

(C) left and right rear wheel assemblies carried by the frame, each wheel assembly comprising:
(a) a support bracket, attached to the frame assembly;
(b) a fork, carried by the support bracket; and
(c) a wheel, carried by the fork;

(D) a brake assembly, comprising:
(a) left and right brackets, carried by the frame;
(b) a pedal support rod, supported by bearings carried by the left and right brackets;
(c) at least one pedal, carried by the pedal support rod;
(d) left and right lever arms, extending from the pedal support rod;

(e) left and right drive rods extending from the left and right lever arms, respectively; and (f) left and right brake elements, driven by the left and right drive rods, respectively, between a first position wherein the left and right brake elements are not in contact with the left and right rear wheels, and a second position wherein the left and right brake elements are in contact with the left and right rear wheels;

(E) left and right lift cylinder assemblies, each lift assembly comprising:

(a) a support bracket, connected to the frame;

(b) forward and rear slide bars, extending vertically from the support bracket;

(c) an adjustable base, carried by the forward and rear slide bars;

(d) a slide, comprising a base having forward and rear bearings, carried by the forward and rear slide bars, respectively; and (e) a cylinder, having a lower end carried by the adjustable base and a cylinder rod carried by the slide;

(F) a compressed air assembly, comprising an air tank carried by the frame assembly;

(G) a valve assembly, comprising:

(a) left and right pressure valves, connected to the left and right lift cylinder assemblies and to the air tank, respectively;

(b) left and right exhaust valves, connected to the left and right lift cylinder assemblies; and (c) a joystick, movable between a first position in contact with the left pressure valve, a second position in contact with the left and right pressure valves, a third position in contact with the right pressure valve, a fourth position in contact with the right exhaust valve, a fifth position in contact with the left and right exhaust valves and a sixth position in contact with the right exhaust valve; and (H) a support sling assembly, carried between the left and right slides.

* * * * *